US007514677B2

(12) United States Patent
Choi et al.

(10) Patent No.: US 7,514,677 B2
(45) Date of Patent: Apr. 7, 2009

(54) HYBRID ION GUIDE

(75) Inventors: Myoung Choul Choi, Seoul (KR); Hyun Sik Kim, Daejeon (KR); Sung Hwan Kim, Seoul (KR); Jong Shin Yoo, Daejeon (KR)

(73) Assignee: Korea Basic Science Institute, Daejeon (KR)

( * ) Notice: Subject to any disclaimer, the term of this patent is extended or adjusted under 35 U.S.C. 154(b) by 145 days.

(21) Appl. No.: 11/754,226

(22) Filed: May 25, 2007

(65) Prior Publication Data

US 2008/0116373 A1 May 22, 2008

(30) Foreign Application Priority Data

Nov. 20, 2006 (KR) ..... 10-2006-0114340

(51) Int. Cl.
*H01J 49/26* (2006.01)
*H01J 49/42* (2006.01)

(52) U.S. Cl. ..... 250/292; 250/281; 250/396 R

(58) Field of Classification Search ..... 250/292, 250/281, 396 R
See application file for complete search history.

(56) References Cited

U.S. PATENT DOCUMENTS 6,744,043 B2 * 6/2004 Loboda ..... 250/287
2002/0195555 A1 * 12/2002 Weinberger et al. ..... 250/281

OTHER PUBLICATIONS

Myoung Choul Choi, et al., "Simulation Study to Improve Ion Transmission Efficiency through the Gate Valve for an External Ion Injection FT-ICR MS," 54th ASMS Conference on Mass Spectrometry and Allied Topics, May 28, 2006, Seattle, Washington.

* cited by examiner

*Primary Examiner*—Nikita Wells
(74) *Attorney, Agent, or Firm*—Fenwick & West LLP

(57) ABSTRACT

Disclosed is a hybrid ion guide which combines the advantages of the conventional electrostatic ion guide and the RF ion guide, comprising an electrostatic ion guide for transmitting the injected ions and applying a voltage for the ions to be focused upon the center axis of the ion transmission direction, and an RF ion guide which is connected to the electrostatic ion guide and passes the ions focused upon the center of the axis of the ion transmission direction. From the constitution of the hybrid ion guide, ion transmission efficiency can be improved.

9 Claims, 7 Drawing Sheets

HYBRID ION GUIDE

CROSS-REFERENCE TO RELATED APPLICATIONS

This application claims all benefits of Korean Patent Application No. 10-2006-0114340 filed on Nov. 20, 2006 in the Korean Intellectual Property Office, the disclosures of which are incorporated herein by reference.

BACKGROUND OF THE INVENTION

1. Field of the Invention

A conventional mass spectrometer is constructed as generating an ion of the analyzing sample outside in the air and injecting it into the inside of the vacuum chamber by using devices such as Electrospray Ionization (ESI) or Matrix Assisted Laser Desorption Ionization (MALDI). Guiding the injected ions to the detection unit located in the ultra-high vacuum stage in which an actual analysis is performed, ions could be detected and analyzed.

Specifically, the devices such as Fourier Transform Ion Cyclotron Resonance Mass Spectrometer (FT-ICR MS) is comprised of a long ion guide located between the exterior ion injection device and a high magnetic field region in which a detection is performed, and the transmission efficiency of such devices are highly affective on the detection sensitivity of the entire device.

There are two types of generally used ion guides including an electrostatic lens form and an RF multi-pole form.

The present invention relates to a method of stabilizing the ultra-high vacuum stage by locating an electrostatic ion guide, an RF ion guide and a gate valve between those two ion guides, as well as improving the transmission efficiency of the RF ion guide by using the focusing electrostatic ion guide.

2. Description of the Related Art

Since there are relatively large number of electrodes to be controlled, not allowing the ions to deviate from the original path, by means of focusing the ions which are under transmission, the form of an electrostatic ion guide has many optimization parameters, and it also has a defect that the design should be modified according to the constitutional change of the peripheral devices such as the replacement of a superconducting magnet. Particularly, in the high magnetic field over 15 Tesla, if the ions are not focused, the ions leap out again from an increasing incident angle due to the magnetic mirror effect of the ions in a high magnetic field gradient.

In order to improve the ion transmission in such a high magnetic field, it should be optimized by requiring more time for adjusting the voltage of an ion guide.

The form of an RF ion guide as the form of a linear ion trap, could be simply optimized since a few parameters need to be controlled, in which ions are transmitted while confining their movements in a vertical direction to the ion transmission direction by applying an RF voltage, and only permitting the parallel movement along the multi-pole RF ion guide central axis, and also there is an advantage that additional design is not required and only the multi-pole's length need to be adjusted in accordance with the constitutional change of the peripheral devices such as the replacement of a superconducting magnet.

However, partial ions loss could be incurred in a FT-ICR MS which should pass through the region with the variation of the magnetic field. There have been continuous requirements that such problems related to the ion guide needs to be improved. Also, in a FT-ICR MS device, it is general that a gate valve is disposed in the middle of the ion guide system to separate the ultra high vacuum region from relatively low vacuum region. The equipment of this gate valve necessarily separates the ion guide into two isolated ion guides physically, so that it affects the ion path passing through the gate valve to reduce the ion transmission efficiency.

The first method among the various methods which are conventionally being attempted to minimize such a loss is that, making all of the ion guides with an electrostatic lens system to pass through the gate valve. In this case, ion transmission is totally dependent upon an electrostatic ion guide system from the ionization source to the detection unit.

The second method uses an RF multi-pole device as an ion guide, and solved the reduction problem of the ion transmission efficiency passing through the gate valve by minimizing the thickness of the gate valve. Similarly, the RF ion guide is used, and when the gate valve is to be closed, the center part of the RF ion guide is separately moved away from the gate valve, and when the gate valve is to be opened, it is moved again almost to connect the two RF ion guides being slightly separated. However, there have been many difficulties in using those methods, such that the devices are complicated and it is hard to fabricate.

SUMMARY OF THE INVENTION

An object of the present invention is to improve the ion transmission efficiency by the embodiment of a high transmission efficiency hybrid ion guide including a gate valve and the combined ion guide with an electrostatic lens system and an RF multi-pole device.

Specifically, it is being objected to provide a mass spectrometer, especially a FT-ICR MS, with higher sensitivity, by improving the various problems occurred in an ion transmission due to the gate valve in a FT-ICR MS device, and the problems occurred in an ion transmission according to the magnetic field gradient in a FT-ICR MS device which uses a high magnetic filed.

In order to achieve the above mentioned objects, the method suggested in the present invention relates to a hybrid ion guide which combines the advantages of the conventional electrostatic lens system and the RF multi-pole device, comprising an electrostatic ion guide for transmitting the injected ions and applying a voltage for the ions to be focused upon the center of the axis of the ion transmission direction, and an RF ion guide which is connected to the electrostatic ion guide and passes the ions focused upon the ion transmission direction. From the constitution of the hybrid ion guide, ion transmission efficiency can be improved.

Meanwhile, in an apparatus which has large pressure difference in the ion occurring unit and ion detection unit and requires a high degree of vacuum in the detection unit, high degree of vacuum should be stably maintained, and also, ion transmission efficiency should be improved, in order to achieve a device with high sensitivity.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF EMBODIMENTS

Hereinafter, the constitution of the hybrid ion guide of the present invention and the operational principle thereof will be described with reference to the accompanying drawings. In the following description of the present invention, a detailed description of known functions and configurations incorporated herein will be omitted when it may make the subject matter of the present invention rather unclear.

Figure 1:
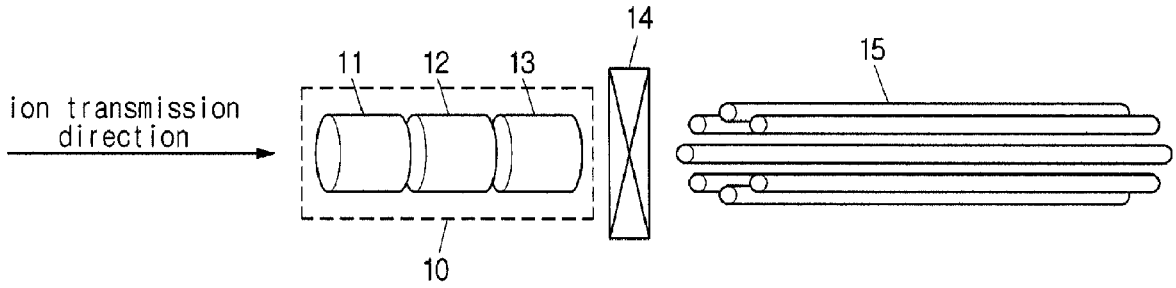
FIG. 1 is a schematic diagram of the structure of a hybrid ion guide according to one embodiment of the present invention.

FIG. 1 shows a schematic diagram of the structure of a hybrid ion guide according to one embodiment of the present invention. As shown in FIG. 1, a hybrid ion guide according to the present invention is comprised of the combination of an electrostatic ion guide (10) and an RF multi-pole device (15), and those elements of the combination is connected by a gate valve (14).

The electrostatic ion guide (10) is one portion of the hybrid ion guide, and the electrostatic ion guide (10) according to one embodiment of the present invention comprises three electrodes to focus the injected ions upon the center of an axis of the ion transmission direction. As such, the electrostatic ion guide (10) comprises three electrodes of a first electrode (11), a second electrode (12), and a third electrode (13), wherein voltages are properly applied.

Generally, as for the embodiment of the electrostatic ion guide (10), the proper combination of voltages will be applied to each electrodes and an insulator is disposed between each pair of electrodes for the electrical isolation and mechanical alignment and the focal point of ions can be adjusted from the combination of voltages. The electrostatic ion guide (10) is implemented in a various forms such as a dual tube form, a corn form, a disc form, and a cylinder form.

An electrode which is used in the electrostatic ion guide includes such as, for example, a stainless steel treated with a breakaway gas, and also an insulator which has the quality of small amount of particle or gas emission under vacuum (e.g. ceramic) could be used. This is due to that it is being operable under ultra-high vacuum in order to minimize the dispersion by the collision with the background residual gas molecules remaining in the device while the ions are proceeding in the hybrid ion guide according to the present invention.

As shown in FIG. 1, for convenience of washing or maintenance such as repairs of the ionization unit, a gate valve (14) is disposed between an electrostatic ion guide (10) and an RF ion guide (15) to isolate as necessary.

As the injected ions are focused upon the axis of the ion transmission direction while passing through the electrostatic ion guide (10), those ions can pass through the gate valve (14) which is disposed between an electrostatic ion guide (10) and an RF ion guide (15). In other words, the electrostatic ion guide (10) is employed on the front side of the gate valve (14) to focus the ions on transmission axis, and is operable to make the ions pass through the gate valve (14).

The ions which are focused upon the ion transmission axis to pass through the gate valve (14) are incident to the center part of the RF ion guide (15) on the back side of the gate valve (14).

As for a hybrid ion guide according to one embodiment of the present invention, an RF ion guide (15) is one of the major component of the hybrid ion guide of the present invention along with the above mentioned electrostatic ion guide (10), and as shown is FIG. 1, the RF ion guide (15) according to the present invention is composed of eight long parallel rods of circular cross-section, with rod centers equally spaced around a circle.

The motion of a charged particle in the presence of an electric field E and a magnetic field B is fully described by the Lorentz equation for ion motion according to the following equation.

$$m\frac{d^2 r}{dt^2} = qE(r, t) + q\frac{dr}{dt} \times B(r, t) \qquad \text{[Equation 1]}$$

$$E = \begin{pmatrix} E_x \\ E_y \\ E_z \end{pmatrix}$$

$$B = \begin{pmatrix} B_x \\ B_y \\ B_z \end{pmatrix}$$

$$r = \begin{pmatrix} x \\ y \\ z \end{pmatrix}$$

in which m and q are the mass and charge of the ion, respectively, and r is the ion position.

Ion transmission efficiency under the influence of the above-mentioned electric field E and magnetic field B is presented in the following descriptions.

Figure 2:
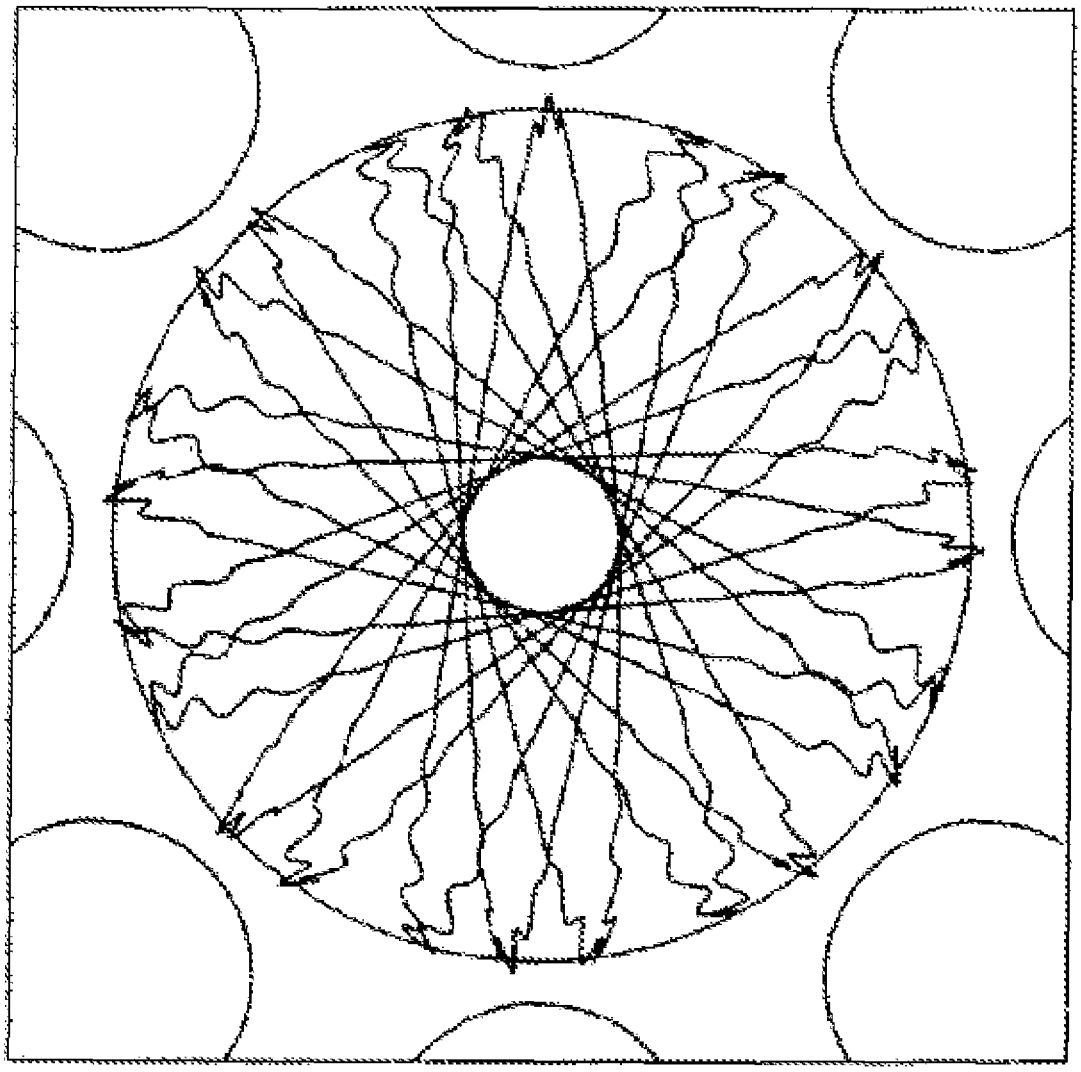
FIG. 2 is a diagram of an ion track in a pseudopotential of RF ion guide without the influence of a magnetic field.

FIG. 2 is a diagram of an ion track in a pseudopotential of RF ion guide without the influence of a magnetic filed. FIG. 2 shows an ion motion in a RF ion guide. Ions are radially confined by pseudo potential filed which is formed from the RF voltage on the electrodes of RF ion guide. RF ion guide is convenient to modify the design and fewer optimizing parameters than static ion guide.

An ion follows an oscillatory motion but stable trajectory within a fixed maximum radius restricted by the confining pseudopotential.

Addition of a magnetic field produces complex ion motion. On entering the guide (where the magnetic field is weak), initial ion motion is similar to that in an RF ion guide in the absence of the magnetic field. As the ion passes into the strong magnetic field region, the ion exhibits cyclotron and magnetron motions similar to those in a Penning trap.

At sufficiently high RF frequency, the electric potential inside the RF ion guide may be approximated by an effective static potential. This is so-called "pseudopotential" may be expressed as:

$$V_{pseudo} = \frac{n^2 q V_0^2 r^{2n-2}}{4m\omega^2 r_0^{2n}} \qquad \text{[Equation 2]}$$

in which 2n is the number of poles of the guide, q and m are charge and mass of the ion, respectively, $V_0$ is the amplitude of the RF filed, $w=2\pi\upsilon$ where $\upsilon$ is the frequency of the RF field, and r is the radial displacement from the center of the ion guide. The effective potential model is based on the adiabaticity of ion motions. In general, the conditions of validity of this assumption can be specified by means of stability parameter $\eta$ defined by:

$$\eta = \frac{8n(n-1)qV_0}{m\omega^2 r_0^2}\left(\frac{r}{r_0}\right)^{n-2} \quad \text{[Equation 3]}$$

in which n is half number of the pole, $r_0$ and r is inner radius of RF ion guide and radial position of ion respectively. For the application of adiabatic approximation, usually the characteristic parameter $\eta$ need to be less than 0.3 for the stable ion motion.

Figure 3:
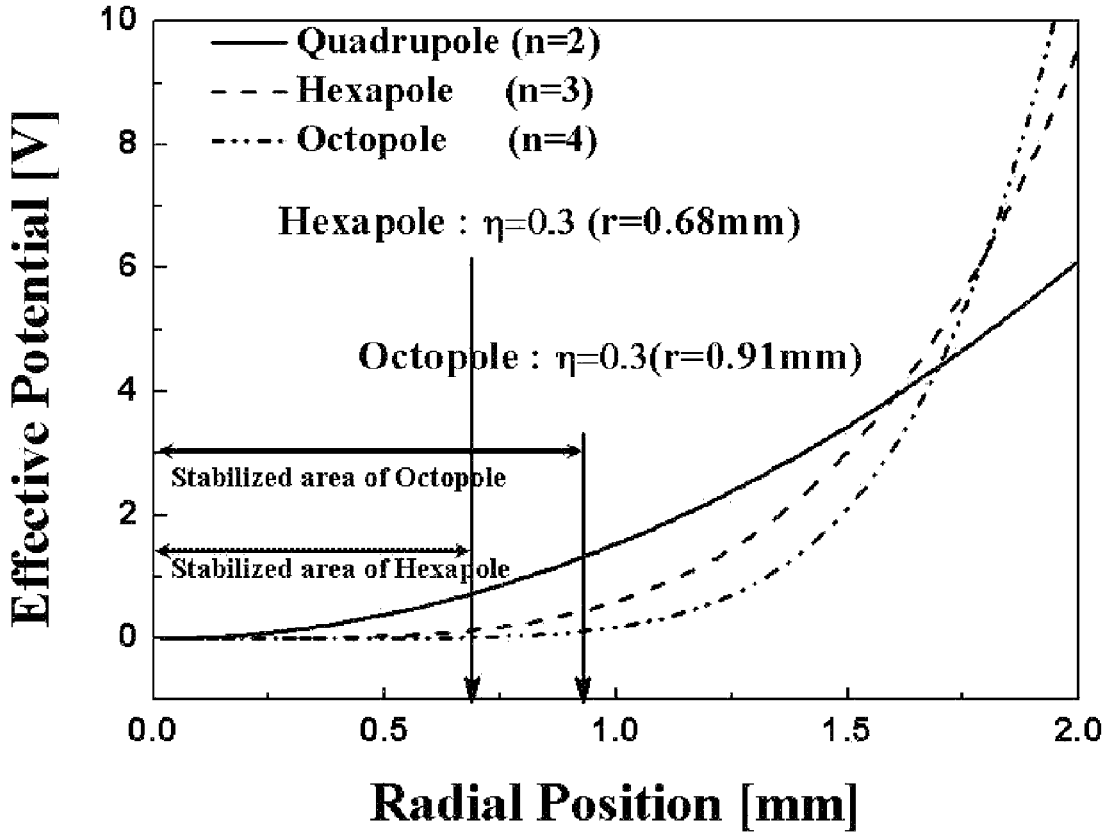
FIG. 3 is a pseudopotential (effective potential) plot as a function of radial position for quadrupole, hexapole and octopole ion guides.

FIG. 3 is a pseudopotential (effective potential) plot as a function of radial position for quadrupole, hexapole and octopole ion guides. As shown in FIG. 3, octopole have a wider stable area than one of quadrupole or hexapole, which means that the octopole supplies wider stable transmission path than the others. And focusing ions on the center of eight poles of octopole ion guide can improve the transmission efficiency through the whole octopole ion guide.

Figure 4:
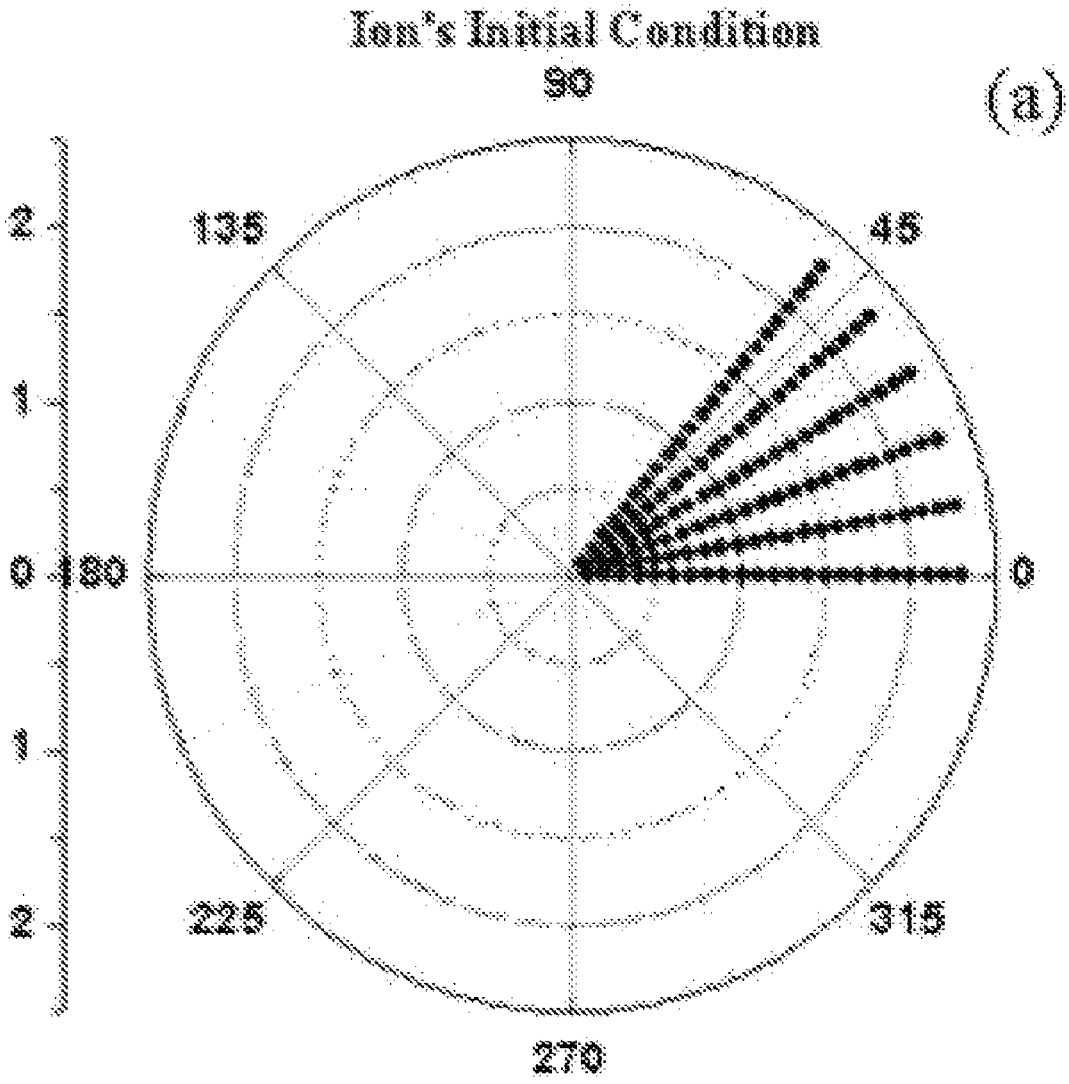
FIG. 4 is initial conditions of guided ions at the beginning point of RF ion guide and hybrid ion guide.

FIG. 4 is initial conditions of guided ions at the beginning point of RF ion guide and hybrid ion guide to calculate the transmission efficiency by a simulation code (SIMION). FIG. 4 shows initial conditions of simulation for the comparison of the RF octopole ion guide and the hybrid ion guide by the simulation study with SIMION program.

Figure 5:
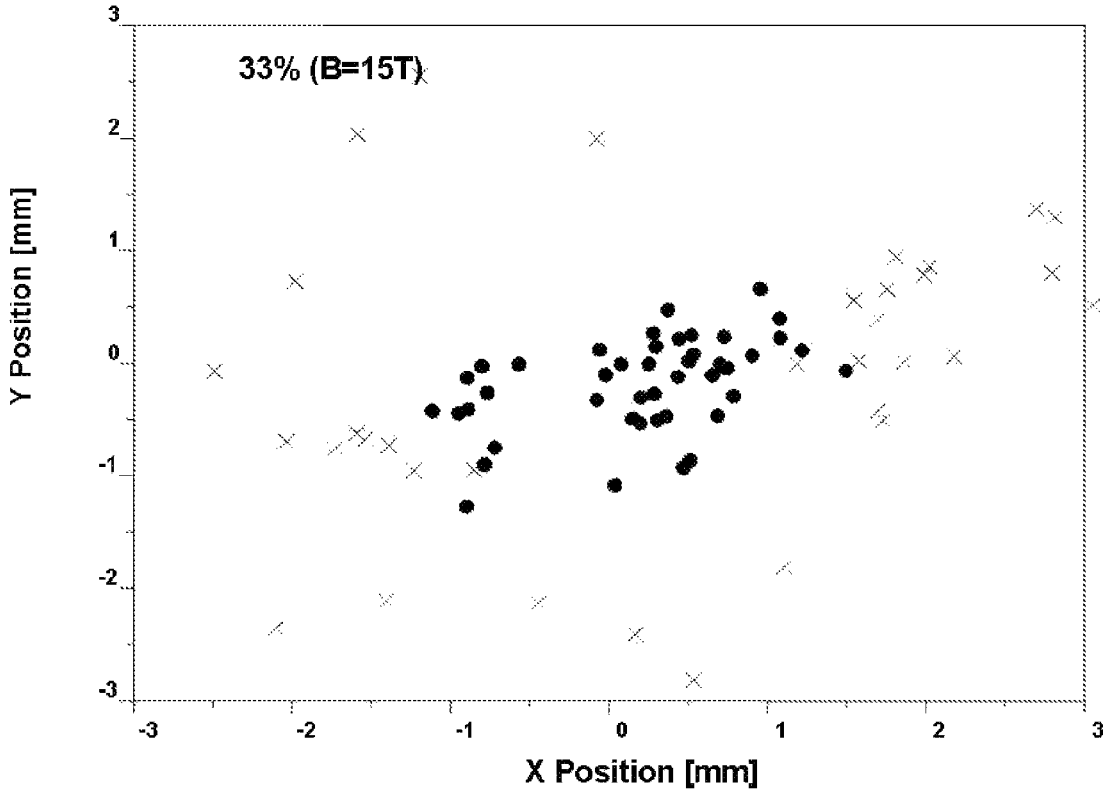
FIG. 5 is a simulation plot of ion's starting positions at the second RF ion guide after passing through the first RF ion guide and the gate valve.

FIG. 5 is a simulation plot of ion's starting positions at the second RF ion guide after passing through the first RF ion guide and the gate valve (gate valve length is 15 mm) with initial conditions as described as in FIG. 4 under 15 Tesla high magnetic field. "X" indicate that ion is fail to transmit through the ion guide, and "•" indicate ion's successful transmission. As shown in FIG. 5, in case of RF octopole ion guide, ions are start to diffuse after the first RF ion guide and the gate valve. The radial spreading of ions after the first octopole affect on the transmission efficiency through the second octopole (15). The transmission efficiency of RF ion guide is around 33%. But, in case of hybrid ion guide as in FIG. 6, ions are focused to the center of RF ion guide transmission axis using electrostatic ion guide, and then the radial spreading of ions is much smaller than one in the RF octopole ion guide. Their transmission efficiency is around 100% within the same initial condition as in FIG. 4, which means that focusing with an electrostatic ion guide before entering the RF ion guide can improve the transmission efficiency.

Conclusively, as for the constitution of an ion transmitting device according to the present invention, an electrostatic ion guide is employed in front of the gate valve and operated to focus the ion path to pass through the gate valve, and the subsequent path is to transmit the ions to the detection unit by using the RF ion guide.

Figure 6:
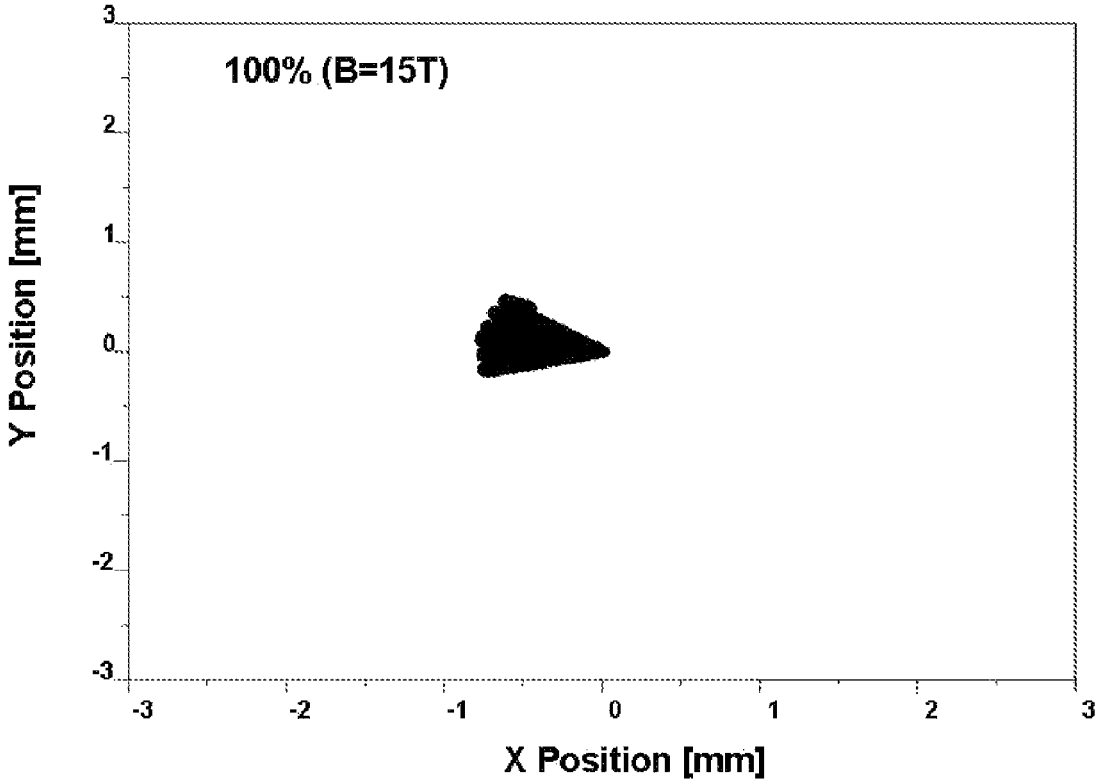
FIG. 6 is a simulation plot of ion's starting position at the second RF ion guide after passing through the electrostatic ion guide and the gate valve.

FIG. 6 is a simulation plot of ion's starting position at the second RF ion guide after passing through the electrostatic ion guide and the gate valve (gate valve length is 15 mm) in each initial conditions as described as in FIG. 4 under 15 Tesla high magnetic field. Most of ions passed through the hybrid ion guide. As shown in FIG. 6, the focused ions for the purpose of passing through the gate valve after the electrostatic ion guide are focused upon the starting part of RF ion guide to improve the transmission efficiency of RF ion guide under the influence of the high magnetic field, and this was calculated by SIMION program.

Therefore, the present invention could utilize both of the advantages including the facility to pass through the gate valve after the electrostatic ion guide and the high ion transmission efficiency of the RF ion guide in the high magnetic field gradient region, with the constitution combining the feature of the electrostatic ion guide and the RF ion guide.

Figure 7:
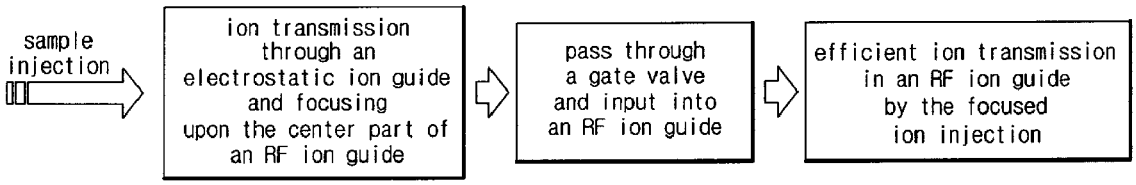
FIG. 7 is a flow diagram describing an operational principle of a hybrid ion guide according to one embodiment of the present invention.

FIG. 7 shows the flow of the operation mechanism of the hybrid ion guide according to one embodiment of the present invention.

According to this mechanism, regarding the general operation of the hybrid ion guide of the present invention, when an injected ion having a variety of mass is incident through the electrostatic ion guide, the electrostatic ion guide induces the samples to pass through the gate valve, and simultaneously, applies voltage such that the samples could be collected in the central region of the ion transmission axis. The samples are injected through the sample injection device and then converted to an ion in an ionization source. Finally, the ions will be transmitted through the ion guide to the detector located far from the ionization source.

The samples which have passed through the gate valve is incident on the center of the RF ion guide located in the next place by the electrostatic ion guide, and the ions collected in the center of the RF ion guide are minimally affected by the fringe electric field occurred in the initial part of the RF ion guide, and $\eta$ will have lower than 0.3. Therefore, ions are transmitted more stably, so the higher transmission efficiency is to be expected.

Therefore, due to the higher ion transmission efficiency and simultaneously, the more stable ultra-high vacuum stage, the detection sensitivity is increased by minimizing the signal attenuation occurred from the collision with the neighboring neutral gas.

As described above, in a hybrid ion guide constituted with the combination of an electrostatic ion guide and an RF ion guide which includes a gate valve according to the present invention, the sensitivity of the ion detector could be improved by maintaining a stable high vacuum condition and increasing an ion transmission efficiency.

In a device such as a FT-ICR mass spectrometer, which requires ultra-high vacuum condition and wherein the detection unit is located far away from the sample injection unit, an improved ion transmission efficiency and a stable vacuum condition is provided to minimize the signal attenuation occurred from the collision with the neighboring residual gas, and therefore, the hybrid ion guide could be used to improve the detection sensitivity and the resolving power.

While the invention has been shown and described with reference to certain preferred embodiments thereof, it will be understood by those skilled in the art that various changes in form and details may be made thereto without departing from the spirit and scope of the invention as defined by the appended claims.

What is claimed is:

1. A hybrid ion guide comprising:

an electrostatic ion guide for transmitting the injected ions and applying a voltage such that said ions can be focused upon the axis of the ion transmission direction; and an RF ion guide which is connected to said electrostatic ion guide, and carries said ions forward a detection region along the pseudopotential minimum center axis.

2. The hybrid ion guide according to claim 1, wherein said electrostatic ion guide and said RF ion guide are connected by a gate valve, and the ions passing through said gate valve are incident to the center part of said RF ion guide by said electrostatic ion guide.

3. The hybrid ion guide according to claim 1, wherein said electrostatic ion guide is composed of couple of electrodes, wherein proper voltages of electrodes are applied to focus ions.

4. The hybrid ion guide according to claim 1, further comprising an insulator disposed between said electrodes for the isolation and the fixation of said electrodes.

5. The hybrid ion guide according to claim 1, wherein the insulator has the quality that the amount of the particle or gas emission under vacuum is small.

6. The hybrid ion guide according to claim 1, wherein the form of said electrostatic ion guide is one of a tube form, a corn form, a disc form and a cylinder form.

7. The hybrid ion guide according to claim 4, wherein said insulator can not be seen from the line of sight of the injected ions, thereby preventing the charge accumulation which may disturb the injected ion trajectory.

8. The hybrid ion guide according to claim 1, wherein said RF ion guide is composed of long parallel multiple rods of circular cross-section, and equally spaced around a circle.

9. The hybrid ion guide according to claim 1, wherein said RF ion guide achieves desired transmission efficiency by adjusting the RF amplitude and RF frequency.

* * * * *